United States Patent [19]

Grasshoff et al.

[11] Patent Number: 5,049,292

[45] Date of Patent: Sep. 17, 1991

[54] LUBRICANT COMPOSITION FOR REFRIGERATOR SYSTEMS

[75] Inventors: Hans D. Grasshoff; Vladislav Synek, both of Hamburg, Fed. Rep. of Germany

[73] Assignee: Texaco Technologie Europa GmbH, Fed. Rep. of Germany

[21] Appl. No.: 371,688

[22] Filed: Jun. 23, 1989

Related U.S. Application Data

[63] Continuation of Ser. No. 873,561, Jun. 12, 1986, abandoned.

[30] Foreign Application Priority Data

Jun. 21, 1985 [DE] Fed. Rep. of Germany ..... 3522165

[51] Int. Cl.[5] ..... C10M 137/04

[52] U.S. Cl. ..... 252/49.6; 252/49.8; 252/67; 252/68

[58] Field of Search ..... 252/67, 68, 49.8, 49.6

[56] References Cited

U.S. PATENT DOCUMENTS

| | | | |
|---|---|---|---|
| 2,391,311 | 12/1945 | Helmore | 252/49.8 |
| 3,280,031 | 10/1966 | Brennan et al. | 252/49.8 |
| 3,459,660 | 8/1969 | Shepherd | 252/49.8 |
| 4,033,887 | 7/1977 | DeRoocker | 252/49.8 |
| 4,072,027 | 2/1978 | Berenbaum et al. | 252/68 |
| 4,116,877 | 9/1978 | Outten et al. | 252/49.8 |
| 4,199,461 | 4/1980 | Olund | 252/49.8 |
| 4,454,052 | 6/1984 | Shoji et al. | 252/67 |
| 4,557,850 | 12/1985 | Ando et al. | 252/68 |

*Primary Examiner*—Prince E. Willis
*Assistant Examiner*—Ellen McAvoy
*Attorney, Agent, or Firm*—Thomas H. Whaley

[57] ABSTRACT

A lubricant for refrigerators which contains phosphate, phosphite and/or silicone additives which impart stability and thermal stability to the lubricant.

12 Claims, No Drawings

LUBRICANT COMPOSITION FOR REFRIGERATOR SYSTEMS

This is a continuation of application Ser. No. 873,561, filed June 12, 1986, now abandoned.

FIELD OF THE INVENTION

This invention relates to lubricants; and more particularly, it relates to oil lubricants for refrigerator systems.

BACKGROUND OF THE INVENTION

Generally, it is known that lubricants for refrigerator oils consist predominantly of highly refined mineral oils which have been dewaxed in excess of what is usual for lubricating oils in order to improve the flow properties at low temperatures.

Depending on the viscosity, usual pour-points for refrigerating machines are within a range of −50° C. to −25° C., and the low-temperature pour-points in accordance with DIN 51568 are within a range of −16° C. to −38° C. The temperature at which flocculation of the paraffin crystals occurs, which is important for the proper function of the lubricant, is likewise decreased by the additional dewaxing step.

The mineral oils suitable for the production of refrigerator oils are obtained by the known techniques through distillation of crudes and subsequent refining (*Ullman Encyklopadie der technischen Chemie*, 4th edition, vol.20, pp.484 et seq.). Depending on the origin of the raw material petroleum, so-called paraffin-base or naphthenic-base lubricating oils are obtained.

Paraffin-base lubricating oils comprise, predominantly, paraffinic molecules, while naphthenic-base ones comprise, predominantly, naphthenic or cycloparaffinic molecules respectively. Because of their superior properties at low temperatures, naphthenic-base oils are preferred for the production of refrigerator oils. Mineral oil-based refrigerator oils, in most cases, do not contain any additives.

In recent years, the technical advance in the field of refrigerating engineering has resulted in a continual increase of the requirements to be met by the lubricant and that both in respect of the low-temperature characteristics and of the thermal stability. In particular, elevated operating temperatures have caused premature fatigue of conventional refrigerator oils having no additional protection against aging so that premature replacement of such oils had be effected The increased efficiency of modern refrigeration units also makes higher demands on the lubricating properties of a refrigerator oil in respect to the protection of frictionally engaged machine components from wear.

That is why there is a present need for improved lubricants for refrigerator systems. Thus, it is a primary object of the present invention to provide an improved lubricant for refrigerator systems and refrigerators.

INFORMATION DISCLOSURE STATEMENT

*ASHRAE Guide and Data Book* (1969, section 23, p.281) discloses that, although it has frequently been attempted to improve the properties of the oils by means of additives, such attempts have not proved successful. Recently, synthetic hydrocarbons such as alkylbenzenes and poly-α-olefins have been used increasingly refrigerator oils. As compared to mineral oils, they mainly offer the advantage of improved low-temperature characteristics in respect of their flow properties and also because they naturally do not liberate any paraffins. These oils likewise, in most cases, do not contain any additives. See also *ASHRAE Systems Handbook* (1980, section 32). A further discussion is by Hans. O. Spauschus, Evaluation of Lubricants for Refrigeration and Air Conditioning Compressors, ASHRAE (Kansas City, 1984).

U.S. Pat. Nos. 3,458,443 and 3,459,660 disclose the use of organic phosphites for improving the stability of lubricants for refrigerator compressors.

Ullman (4th edition, Vol.14, pp.672, et.seq.) discloses that the alkyl benzenes, used for refrigerator systems, originate from the known Friedel-Crafts synthesis by alkylation of benzene with alkylchlorides or olefins. Ullman (4th edition, Vol.14, pp.664, et.seq.) discloses that the raw material for the production of polymer oils are α-olefins which are obtained by various techniques through ethylene oligomerisation, or through cracking of paraffins, according to different techniques. In the next step, these α-olefins are polymerised and hydrogenated (see *Synthetic Poly-α-olefin Lubricants Today and Tomorrow*; M. Campen, D.F. Kendrick, A.D. Markin and Ullman, 4th edition, Vol.20, pp.505, et.seq.).

U.S. Pat. No. 4,199,461 discloses that in improving refrigerator systems, it has been attempted to use wear-reducing additives, e.g., phosphate esters. However, the addition of phosphate ester leads to a reduction of the thermal stability of the lubricating oil. According to the duPont pamphlet, *FREON Product Information RT-56E, tricresylphosphate (TCP) is recommended as improver for alkylbenzene lubricant, but it is pointed out that this additive detrimentally affects the stability of the system.*

ASHRAE (Kansas City, 1984, p.9) discloses that the negative effect caused by the addition of organic phosphates, in respect of the thermal stability of the lubricants, is not only mentioned in the duPont pamphlet, *FREON Product, supra*,) but also therein, by Hans O. Spauschus, *Evaluation of Lubricants for Refrigeration and Air Conditioning Compressors.*

SUMMARY OF THE INVENTION

This invention provides lubricating oils having improved lubricating characteristics, as well as improved low-temperature behavior and improved thermal stability, and a reduced foaming property.

The invention, in particular, provides a mineral oil lubricant containing mineral oils, synthetic lubricating fluids, and/or mixtures of mineral oils and synthetic lubricating fuids. The synthetic lubricating fluids comprise (a) dialkylbenzenes or mixtures of mono- and dialkylbenzenes which have straight-chain and branched-chain ($C_1$–$C_{20}$) alkyl groups and/or (b) poly-olefins; the additives are comprised of (i) an organic phosphate of the formula

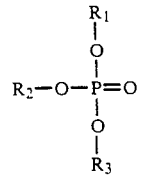

wherein $R_1$, $R_2$ and $R_3$ are ($C_1$–$C_{15}$) alkyl, aryl and alkylaryl group, which may be the same or different, in an amount of about 0.01 to about 10 wt. %, based on the total weight of the lubricant;

(ii) an organic phosphite of the formula

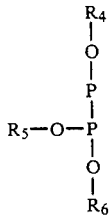

wherein $R_4$, $R_5$ and $R_6$ are ($C_1$-$C_{15}$) alkyl, aryl and alkylaryl groups, which may be the same different in an amount of about 0.001 to about 1.0 wt. %, based on the total weight of the lubriccant, and optionally (iii) an organic or organohalogen silicone in an amount of about 0 to about 100 mg, based on a total weight of 1 kg of the lubricant.

Such lubricants are especially suitable for use in refrigerating machines, heat pumps and related equipment, such as air conditioning units. In addition, they may also be used as compressor and hydraulic oils.

DESCRIPTION OF THE INVENTION

The lubricants which may be used according to the present invention, include, in addition to dialkylbenzenes and polyolefins, additives which are comprised of (i) an organic phosphate of the formula

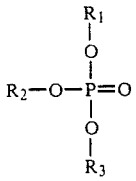

wherein $R_1$, $R_2$ and $R_3$ are ($C_1$-$C_{15}$) alkyl, aryl and alkylaryl group, which may be the same or different, in an amount of about 0.01 to about 10 wt. %, based on the total weight of the lubricant, (ii) an organic phosphite of the formula

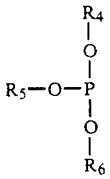

wherein $R_4$, $R_5$ and $R_6$ are ($C_1$-$C_{15}$) alkyl, aryl and alkylaryl groups, which may be the same or different, in an amount of about 0.001 to about 1.0 wt. %, based on the total weight of the lubricant, and (iii) an organic or organohalogen silicone in an amount of about 0 to about 100 mg, based on a total weight of 1 kg of the lubricant.

Thus, it has been found that a further additive, in addition to the phosphate ester, i.e., the addition of an organic phosphite, will result in a significant improvement of the quality of the refrigerator oils. The combination with phosphate esters causes improved oxidation stability and thermal stability of the lubricants and also improved wear protection.

According to the present invention, it also has been found that the combination of organic phosphites and phosphates will improve the thermal and oxidation stability of the lubricants in excess of that of the base oils. This forms the basis of the instant invention.

Thus, it has been found that lubricants, preferably for refrigerant compressors, heat pumps and related uses consisting of (a) a base oil based on mineral oils (b) a base oil based on alkylaromatic compounds (c) a base oil based on poly-α-olefins, and (d) a base oil mixture of mineral oil and alkylaromatic compounds, or poly-α-olefins, or a combination of additives, may be obtained which have improved thermal and oxidation stability as well as wear-reducing properties, may be added provided the additives used are:

(1) at least one organic substituted phosphate of the general formula I in an amount of about 0.5 to about 5.0 wt. %, preferably of 1 to 2 wt. %, based on the total weight of the lubricant, (2) at least one organic substituted phosphite of the general formula II in an amount of about 0.05 to about 0.5 wt. %, preferably of about 0.1 to about 0.2 wt. %, based on the total weight of the lubricant, and (3) at least one organic or organohalogen silicone and especially fluoro-organosilicone in an amount of about 1 to about 50 mg, preferably of about 3 to about 10 mg/kg of total lubricant.

In the combination of additives, according to the present invention, the substituted phosphite may, for example, be a trinonylphenyl phosphite, triphenyl phosphite, dodecyldiphenyl phosphite, dioctylphenyl phosphite, tridodecyl phosphite, didecylphenyl phosphite. Use of the phosphites, having medium molecular size such as dodecyldiphenyl phosphite or triphenyl phosphite, is preferred.

Examples of the organic phosphates are diphenylcresyl phosphate and other alkyl, aryl or alkylaryl derivatives of cresyl phosphate. Use of trialkylaryl phosphates, such as tri-isopropylphenyl phosphate or tricresyl phosphate, is especially preferred.

The preferred silicone is a methyl silicone. Its primary function is to reduce foaming.

To demonstrate the improved properties of the lubricants according to the present invention, mixtures were subjected to an aging test developed by Elsey and Spaushus for refrigerator oils and explained in the following publications:

H. M. Elsey, L. C. Flowers, J. B. Kelley, *A Method of Evaluating Refrigerator Oils*, Refrigerating Engineering, (July 1952, pp.737 to 743 and 782

H. O. Spauschus, G. C. Doderer, *Reaction of Refrigerant 12 with Petroleum Oils*, ASHRAE Journal, (Feb. 1961, pp.65 to 69)

ASHRAE Standard 97p, *Method for Chemical Stability Testing of Materials Using Sealed Glass Tubes*, (draft of July 9, 1982)

The tests were conducted as follows:

Appropriately prepared, cleaned and pickled glass tubes, having a length of 200 mm and an inner diameter of 5 to 7 mm, were sealed at one end and tapered at the other end, over a length of about 5 cm to 1.5 mm.

Into correspondingly prepared glass tubes a helix of 0.1 mm copper wire and a steel wire 1.6 DIN 177-D5-1, of a length of about 15 mm, were introduced, an initial weight of 0.3 to 0.4 g of lubricant was introduced and, in a special apparatus, the approximately equal amount of refrigerant Freon was added under vacuum and deep cooling. Prior to the last-mentioned step, all gases from were expelled from the weighed-in oil by means of vacuum. Following the addition of the refrigerant, the glass tubes were sealed while nitrogen was supplied. Subsequently, the glass tubes were heated, within a predetermined period of time, in a drying oven to the test temperature. The test temperature was 175° C. and 200° C., respectively; the testing period was between 336 and 1008 hours (2 to 6 weeks).

During the test the samples were visually inspected for changes in color. After termination of the test, the glass tubes were broken and gas and oil were collected for examination purposes.

For confirmation of the improved properties, four glass tubes were respectively filled with the same lubricant. Three glass tubes were subjected to the aging test. The fourth glass tube was retained as reference for the change in color and the state of the metals after the test.

The glass tubes of the respective test are indicated below, under the same number, for the comparative example and the examples were subjected to the aging procedure at the same time and for the same period of time. The results are listed in the respective tables following each test.

Symbols in the tables have the following meaning:

| | | |
|---|---|---|
| A | test duration (hours) | |
| B | test temperature (°C.) | |
| C | lubricant viscosity at 40° C. ($mm^2/s$) | |
| D | lubricant color (original) | |
| E | lubricant color after test: visual assessment | |
| F | conversion of the refrigerant Frigen (R12) to Frigen (R22) in % | |
| G | condition of oil (IR-spectrum examination/metals; visual assessment) | |
| Color: (as to D and E) | | |
| water-white | | 0 |
| yellow, very light | | 1 |
| yellow, light | | 2 |
| yellow | | 3 |
| yellow, dark | | 4 |
| yellow-brown | | 5 |
| brown-yellow | | 6 |
| brown, very light | | 7 |
| brown, light | | 8 |
| brown, medium | | 9 |
| brown and darker | | 10 |
| Oil Condition: (as to G) | | |
| slightly aged | | Z |
| aged (slight acid formation). | | Y |
| highly aged (strong acid formation) | | X |
| Metals: (as to G) | | |
| slightly changed | | V |
| film | | U |
| thick coat or partial copper plating | | T |

COMPARATIVE EXAMPLE 1

The base oil used was an alkylbenzene/mineral oil mixture (ratio 1:1), viscosity class ISO 32, in which the alkylbenzene contained straight-chain ($C_{10}$–$C_{12}$) alkyls and the mineral oil proportion consisted of highly refined naphthenic-base oil. One percent of an isopropylated triphenyl phosphate, having an average isopropyl content of 1.5 mol per mol of triphenyl phosphate and 0.115 percent of methyl silicone, were added.

EXAMPLE 1

| | wt. % |
|---|---|
| Base oil as in Comparative Example 1 | 98.845 |
| Tri-isopropylphenyl phosphate | 1.000 |
| Dodecyldiphenyl phosphite | 0.150 |
| Methyl silicone | 0.005 |
| | 100.000 |

TABLE I

| | A | B | C | D | E | F | G |
|---|---|---|---|---|---|---|---|
| Comparative Example 1 | 1008 | 175 | 68 | 3 | 10 | 1.0 | X/T |
| Example 1 | 1008 | 175 | 68 | 3 | 5 | 0.05 | Z/V |

COMPARATIVE EXAMPLE 2

Base oil of alkylbenzene with branch-chain alkyl groups (produced from the reaction of benzene with tetrapropylene), viscosity class ISO 32, with addition of 1 percent of tri-isopropylphenyl phosphae and 0.005 percent of methyl silicone.

EXAMPLE 2

| | wt. % |
|---|---|
| Base oil as in Comparative Example 1 | 98.845 |
| Tri-isopropylphenyl phosphate | 1.000 |
| Dodecyldiphenyl phosphite | 0.150 |
| Methyl silicone | 0.005 |
| | 100.000 |

TABLE II

| | A | B | C | D | E | F | G |
|---|---|---|---|---|---|---|---|
| Comparative Example 2 | 1008 | 175 | 47 | 1 | 10 | 2.85 | X/U |
| Example 2 | 1008 | 175 | 47 | 1 | 7 | 0.05 | Z/V |

COMPARATIVE EXAMPLE 3

Base oil of a mixture of poly- -olefins, viscosity class ISO 68, with addition of 1 percent of tri-isopopyl phenyl phosphate and 0.005 percent of methyl silicone.

EXAMPLE 3

| | wt. % |
|---|---|
| Base oil as in Comparative Example 3 | 98.845 |
| Tri-isopropylphenyl phosphate | 1.000 |
| Dodecyldiphenyl phosphite | 0.150 |
| Methyl silicone | 0.005 |
| | 100.000 |

TABLE III

| | A | B | C | D | E | F | G |
|---|---|---|---|---|---|---|---|
| Comparative Example 3 | 744 | 175 | 67 | 4 | 10 | 0.1 | Z/T |
| Example 3 | 1008 | 175 | 67 | 4 | 6 | 0.05 | Z/V |

EXAMPLE 4

Base oil of a mixture of poly- -olefins, viscosity class ISO 68, with addition of 1 percent of tri-isopropyl phenyl phosphate and 0.005 percent of methyl silicone.

| | wt. % |
|---|---|
| Base oil as in Comparative Example 4 | 98.845 |
| Tri-isopropylphenyl phosphate | 1.000 |
| Dodecyldiphenyl phosphite | 0.150 |
| Methyl silicone | 0.005 |
| | 100.000 |

TABLE IV

| | A | B | C | D | E | F | G |
|---|---|---|---|---|---|---|---|
| Comparative Example 4 | 1008 | 200 | 65 | 4 | 10 | 1.95 | Z/U |
| Example 4 | 1008 | 200 | 65 | 4 | 6 | 0.3 | Z/V |

COMPARATIVE EXAMPLE 5

Base oil of a highly refined naphthenic-base mineral oil, viscosity class ISO 46, with addition of 1 percent of tri-isopropylphenyl phosphate and 0.005 percent of methyl silicone.

EXAMPLE 5

| | wt. % |
|---|---|
| Base oil as in Comparative Example 5 | 98.845 |
| Tri-isopropylphenyl phosphate | 1.000 |
| Dodecyldiphenyl phosphite | 0.150 |
| Methyl silicone | 0.005 |
| | 100.000 |

TABLE V

| | A | B | C | D | E | F | G |
|---|---|---|---|---|---|---|---|
| Comparative Example 5 | 336 | 175 | 32 | 2 | 9 | 0.6 | Y/T |
| Example 5 | 336 | 175 | 32 | 2 | 3 | 0.05 | Z/V |

The Examples show a significant improvement in the quality of the refrigerator oils of the lubricants according to the present invention with respect to oxidation stability and thermal stability over the Comparative Examples.

We claim:

1. A mineral oil lubricant containing mineral oils, synthetic lubricating fluid and/or mixtures of mineral oils and synthetic lubricating fluids, said synthetic lubricating fluids consisting of (a) dialkylbenzenes or mixtures of mon- and dialkylbenzenes which have straight-chain and branched-chain ($C_1$–$C_{20}$) alkyl groups and/or (b) poly-α-olefins and (c) additives which consist of (i) an organic phosphate of the formula

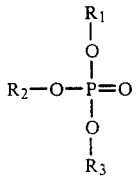

wherein $R_1$, $R_2$ and $R_3$ are ($C_1$–$C_{15}$) alkyl, aryl and alkylaryl group, which may be the same or different, in an amount of about 0.01 to about 10 wt. %, based on the total weight of the lubricant, (ii) an organic phosphite of the formula

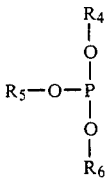

wherein $R_4$, $R_5$ and $R_6$ are ($C_1$–$C_{15}$) alkyl, aryl and alkylaryl groups, which may be the same or different, in an amount of about 0.001 to about 1.0 wt. %, based on the total amount of the lubricant, and optionally (iii) an organic or organhalogen silicone in an amount of about 0 to about 100 mg, based on a total weight of 1 kg of the lubricant.

2. The lubricant of claim 1, wherein the phosphate is present in the amount of about 0.5 to about 5.0 wt. %, based on the total weight of the lubricant.

3. The lubricant of claim 1, wherein said lubricant contains about 1.0 to about 2.0 wt. % of said phosphate, based on the total weight of the lubricant.

4. The lubricant of claim 1, wherein the phosphite is present in an amount of about 0.05 to about 0.5 wt. %, based on the total weight of the lubricant.

5. The lubricant of claim 1, wherein the lubricant contains about 0.1 to about 0.2 wt. % of said phosphite, based on the total weight of the lubricant.

6. The lubricant of claim 1, wherein the silicone is present in an amount of about 1 to about 50 mg, based on a total weight of 1 kg of the lubricant.

7. The lubricant of claim 1, wherein the silicone is present in an amount of about 3 to about 10 mg, based on a total weight of 1 kg of the lubricant.

8. The lubricant of claim 1, wherein said lubricant contains triphenyl phosphate, diphenylcresyl phosphate and/or tricresyl phosphate.

9. The lubricant of claim 1, wherein said lubricant contains isopropylated triphenyl phosphate in an amount of about 1.0 to about 2 mol of isopropyl per mol of triphenyl phosphate.

10. The lubricant of claim 1, wherein said lubricant contains didodecylphenyl phosphite, triphenyl phosphite, dodecyldiphenyl phosphite and mixtures thereof.

11. The lubricant of claim 1, wherein said lubricant contains a methyl silicone.

12. A lubricant consisting of synthetic lubricating fluids, said lubricating fluids consisting of (a) dialkylbenzenes or mixtures of mono- and dialkylbenzenes which have straight-chain and branched-chain ($C_1$–$C_{20}$) alkyl groups and/or (b) poly-α-olefins; and (c) additives which consist of (i) an organic phosphate of the formula

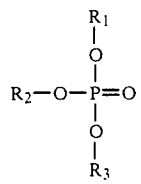

wherein $R_1$, $R_2$ and $R_3$ are ($C_1$–$C_{15}$) alkyl, aryl and alkylaryl group, which may be the same or different, in an amount of about 0.01 to about 10 wt. %, based on the total weight of the lubricant, (ii) an organic phosphite of the formula
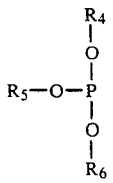
wherein $R_4$, $R_5$ and $R_6$ are ($C_1$–$C_{15}$) alkyl, aryl and alkylaryl groups, which may be the same or different, in an amount of about 0.001 to about 1.0 wt. %, based on the total weight of the lubricant, and optionally
(iii) an organic or organohalogen silicone in an amount of about 0 to about 100 mg, based on a total weight of 1 kg of the lubricant.
* * * * *

UNITED STATES PATENT AND TRADEMARK OFFICE

CERTIFICATE OF CORRECTION

PATENT NO. : 5,049,292

DATED : September 17, 1991

INVENTOR(S) : Hans D. Grasshoff and Vladislav Synek

It is certified that error appears in the above-identified patent and that said Letters Patent is hereby corrected as shown below:

Col. 7, claim 1, line 49, "mon- and dialkyl-" should be --mono- and dialkyl---.

Signed and Sealed this

Thirtieth Day of March, 1993

*Attest:*

STEPHEN G. KUNIN

*Attesting Officer*

*Acting Commissioner of Patents and Trademarks*